United States Patent [19]

Brankamp et al.

[11] Patent Number: 4,519,040

[45] Date of Patent: May 21, 1985

[54] METHOD FOR DETECTING AND RECOGNIZING DEVIATIONS OF CYCLICALLY RECURRING PROCESSES FOR THE SHAPING OF WORKPIECES

[75] Inventors: Klaus Brankamp, Sperber Weg 10, 4006 Erkrath 1; Volker Bialas, Hilden; Heinz B. Bongartz, Düsseldorf, all of Fed. Rep. of Germany

[73] Assignee: Klaus Brankamp, Erkrath, Fed. Rep. of Germany

[21] Appl. No.: 415,010

[22] Filed: Sep. 7, 1982

[30] Foreign Application Priority Data

Sep. 15, 1981 [DE] Fed. Rep. of Germany ..... 3136433

[51] Int. Cl.[3] ..... G06F 15/46

[52] U.S. Cl. ..... 364/474; 364/153

[58] Field of Search ..... 364/474, 475, 153, 183, 364/552, 150; 318/561

[56] References Cited

U.S. PATENT DOCUMENTS

| | | | |
|---|---|---|---|
| 3,274,377 | 9/1966 | Morison | 364/552 |
| 3,819,916 | 6/1974 | Watanabe | 364/474 |
| 3,967,515 | 7/1976 | Nachtigal et al. | 364/474 |
| 4,078,195 | 3/1978 | Mathias et al. | 318/561 |
| 4,176,396 | 11/1979 | Howatt | 364/474 |
| 4,214,191 | 7/1980 | Watanabe et al. | 318/561 |
| 4,279,013 | 7/1981 | Cameron et al. | 364/153 |
| 4,314,329 | 2/1982 | Crewe et al. | 364/474 |
| 4,326,257 | 4/1982 | Sata et al. | 364/474 |
| 4,329,096 | 5/1982 | Herscovici | 364/475 |
| 4,422,150 | 12/1983 | Keller et al. | 364/475 |
| 4,442,493 | 4/1984 | Wakai et al. | 364/474 |

*Primary Examiner*—Jerry Smith
*Assistant Examiner*—Louis Woo
*Attorney, Agent, or Firm*—Martin A. Farber

[57] ABSTRACT

A method is disclosed of detecting and recognizing deviations from normal cause of cyclically recurring processes for the shaping of workpieces, in particular upon the profiling of elongated blanks of circular cross section by shaping from the solid, for instance upon the hobbing or rolling of threads. In order to determine impermissible deviations already during the course of the process and be able to intervene in the process before the production of the next workpiece, the power expended to carry out a shaping process on the basis of a normal course of the shaping is determined from the start to the end of the course of the force output at a suitable point of a tool, and these values are stored and the corresponding values of each of the cyclically recurring shaping processes are determined and compared with the values stored, deviating values which exceed a predetermined range of tolerance leading to a sorting-out of the workpiece and/or to an interruption of the shaping processes, depending on the nature of the deviation.

5 Claims, 1 Drawing Figure

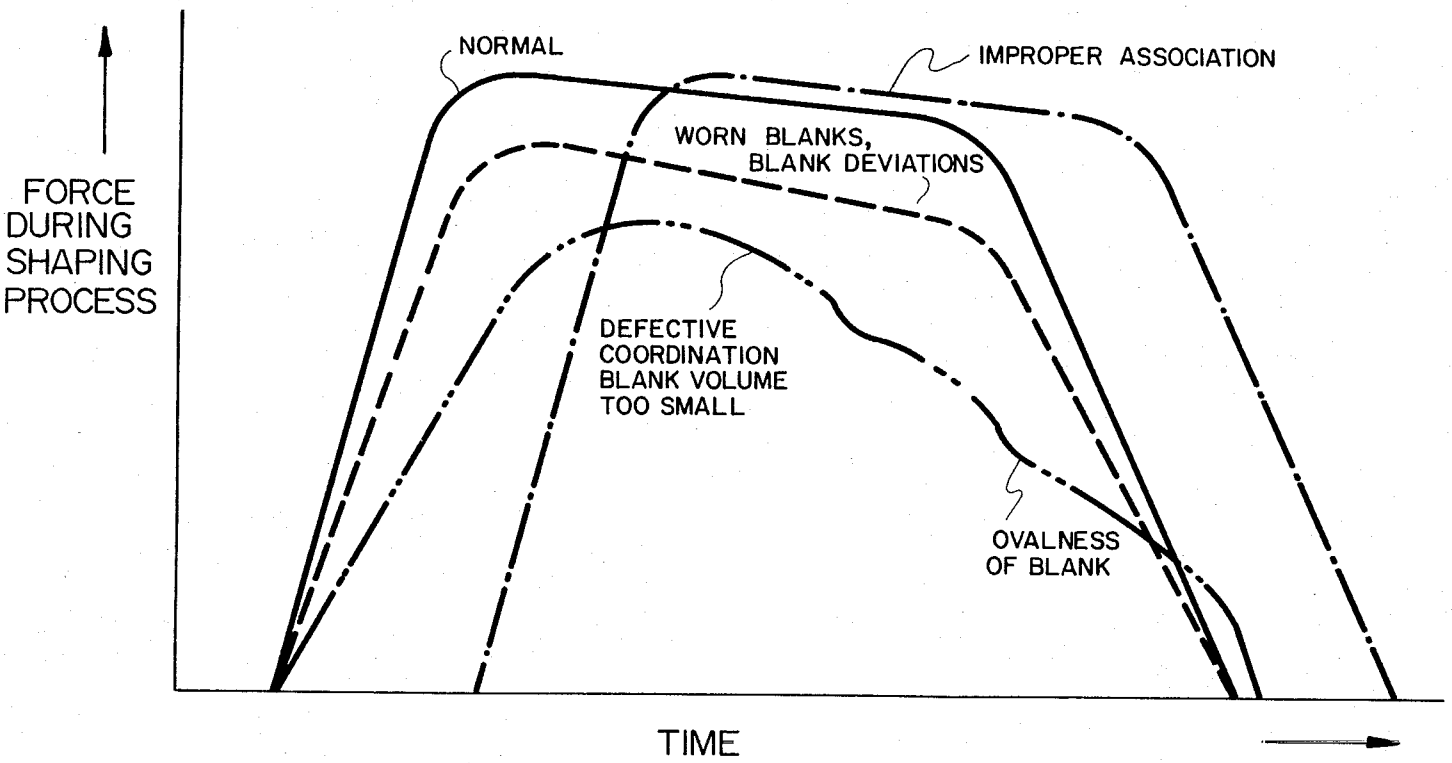
IMPROPER ASSOCIATION
WORN BLANKS,
BLANK DEVIATIONS
NORMAL
DEFECTIVE
COORDINATION
BLANK VOLUME
TOO SMALL
OVALNESS
OF BLANK
FORCE
DURING
SHAPING
PROCESS
TIME

METHOD FOR DETECTING AND RECOGNIZING DEVIATIONS OF CYCLICALLY RECURRING PROCESSES FOR THE SHAPING OF WORKPIECES

The invention relates to a method of detecting and recognizing deviations from a normal course of a cyclically recurring process for the shaping of workpieces, particularly upon the profiling of elongated blanks of circular cross section by shaping from the solid, for instance upon the hobbing or rolling of threads.

Shaping from the solid has been employed for a long time for the profiling of cylindrical or approximately cylindrical bodies. These methods are of particular importance for producing threads on screws and bolts of all types as well as on other threaded parts. The work is carried out, inter alia, between flat profiled jaws, one of which is stationary while the other is moved cyclically. In a continuous process, a plurality of stationary segmental jaws are associated with a continuously rotating tool.

In each case the workpiece must carry out a well-defined rolling motion between the two associated tool parts which move relative to each other. For this purpose, the course of the movement of the tools must be brought into agreement with the course of the movement of the workpiece. Deviations lead to errors in profiling. If these errors in profiling exceed a predetermined amount, the workpiece is unusable.

In practice, the machine operator has heretofore had available to him, for checking the agreement, only devices which permit occasional testing on the workpiece after it has already been produced. Due to the rapid operational speed of the machines, amounting to as much as several hundred cycles per minute, and due to the fact that the operator is not continuously on hand, it is unavoidable that over a long period of time rejects will be produced.

Accordingly, it is an object of the present invention to provide a method of detecting and recognizing deviations from the normal course of a cyclically recurring process for the shaping of workpieces, in which a verification effected during the course of operation determines impermissible deviations already during the process, so that a change may be made in the operating process before the production of the next workpiece in order either to take measures to prevent the occurrence of defects or to interrupt the process in order to eliminate the source of defects.

This purpose is achieved according to the present invention in such manner that, from the start until the end of the course of the force output, the force applied to carry out a shaping process is determined on the basis of a normal process of shaping at a suitable point of a tool, and these values are stored. The corresponding values of each of the cyclically recurring shaping processes are determined and compared with the stored values. Deviating values which exceed a predetermined range of tolerance, depending on the nature of their deviation, leading to the sorting-out of the workpiece and/or to the interruption of the shaping process.

In contradistinction to the previously known methods of detecting and recognizing deviations in machining processes, it is not the course of movement of the tools or of special machine parts which is employed according to the present invention, but rather the variation with time of an expression of the force of the process which is characteristic of the shaping and which by no means need correspond to the total force or power expended for the shaping process but must merely be capable of characterizing the shaping process. It is therefore sufficient for a part of the tool or the tool holder to be provided with a force recorder; it is not necessary that this force recorder indicate, for instance, the entire force of the shaping process. In this way the necessity to act on the tool can be reduced to a minimum. In particular, it is possible to provide existing tools with the required force measuring device.

In order to obtain the values for the normal course which serves as a reference, it is not necessary in the method of the invention to calculate these values or determine them in advance in any other manner. According to the invention, these values are obtained by carrying out a shaping process which has been set up and recognized as proper by the operator, and establishing its measurement values. Preferably, a series of shaping processes are evaluated to serve as reference value rather than the values of a single shaping process.

The method of the invention, which employs known electronic circuits with the inclusion of a microprocessor, has the advantages that the equipment necessary for it can be retrofitted also on existing machines, that defective workpieces can be sorted out; and that, independently of the operator, one can intervene immediately in the shaping process as a result of the recognition of the defect so that it is possible even to work with "ghost shifts" without operators. As a result of the immediate recognition of the defect, workpieces which lie outside the range of tolerance can be sorted out immediately. The high calculating speed of the microprocessor furthermore makes it possible to eliminate the sources of error during the operating process before additional damage to the tool or the machine occurs or rejects result.

In accordance with another feature of the invention, it is possible in particular, on the basis of a deviation of the start and/or of the end of the course of force from the normal course of check the association of parts of workpieces with respect to each other and/or to the blank, and, if necessary, to readjust them. This type of deviation indicates, in particular, errors in the association either between tool parts or between the tool or its parts and the blank.

Further predictions as to the occurrence of defects can be obtained from the specific variation of the force with time. Thus, in accordance with another feature of the invention, it is possible, in the event of a deviation of the course of the power from the normal course, to determine the nature of the deviation, associate it with a given source of error, and display it as identifiable error information.

If, for instance, the maximum value of the power is not reached in a single shaping process, this indicates insufficient volume of the blank. On the other hand, if the maximum power is not reached in successive shaping processes, then the shaping tool is worn. The trend of the deviations from the maximum value can be used to obtain predictions as to the development of wear. Suddenly occurring damage to tools expresses itself in suddenly occurring changes in the course of force. Changes in the rise and descent of the force can indicate errors in the feeding of the blanks and in the association of the individual parts.

In a further development according to the present method of the invention, the measures which must be taken to eliminate the source of error are indicated in connection with each error report. These measures result from the experience had in connection with the shaping process in question, and can be indicated in accordance with their frequency and probability.

Finally, it is possible with the invention to use all error information as control command for direct intervention in the operation of the machine. In this way it is possible to carry out the cyclically recurring shaping processes even without the presence of operators in so-called "ghost shifts," which are not interrupted as soon as errors occur but can be extended beyond the time of the occurrence of errors due to recognition of the errors, ascription of the sources of disturbance and control of the remedying measures.

With the above and other objects and advantages in view, the present invention will become more clearly understood in connection with the detailed description of a preferred embodiment, when considered with the accompanying drawing, which shows the variation of the force in several shaping processes.

The solid line shows the variation of the force of a shaping process such as occurs upon the rolling of the threads of a screw on a hobbing die. After a continuous rise of the force, the maximum force is reached; the blank is in full engagement with the tools. The profile is then shaped with a slight decrease in force; the force then drops continuously back to zero while the finished workpiece emerges from the tool.

The dot-dash curve in the drawing represents a shaping process which, while it corresponds in the course of the force to the normal course shown in solid line, nevertheless has its beginning and end displaced in time as compared with the normal course. This indicates that the association either between the tool parts and/or between the tool and the blank is not proper. This lack of coincidence has thus led to a defective product. The dot-dash course of the curve is therefore indicated as the corresponding defect. At the same time, the measures which must be taken in order to remedy this are signalled.

The course of the curve marked by two dots and a dash characterizes a shaping process which deviates from the normal course, not only with respect to the maximum value of the force expended, but also with respect to the entire course of the curve. Depending on the shaping process, different factors may be controlling for this. Failure to reach the maximum force indicates defective association or too small a volume of the blank. The undulations in the further course of the force may, for instance, indicate ovalness of the blank.

Finally, the dashed-line curve of the diagram shows a change in the course of the force as compared with the normal course produced as a result of continuous wear of the tools. By a predetermination of tolerances and possibly the establishing of a prognosis based on a plurality of measurement data, an error signal can be given off despite the continuous nature of these changes, said signal serving either to interrupt the operating process or to reset the tools. A microprocessor used for the method of the invention is thus able to utilize the longest possible life of the tools despite the unavoidable wear.

If the courses of the force which are characterized by the dashed line occur individually, they are an indication of impermissible deviations of the blank. In this case, a curve having the shape of the dashed line results in the workpiece produced being separated out as defective without the cyclically recurring shaping processes being interrupted.

Another important criterion for the correctness of the shaping process is the area enclosed by the curve in question. It represents a criterion of the deformation work. The size of the area can also be determined by the microprocessor directly during the operating process so that it can be used for the detection and elimination of errors.

We claim:

1. A method of detecting and recognizing deviations from a normal course of cyclically recurring processes for the shaping of workpieces from the solid by cold-working, particularly upon the profiling of elongated blanks of circular cross section by shaping from the solid, for instance upon thread-rolling, the improvement comprising determining values of force employed to carry out a shaping process in case of the normal course of the shaping of a workpiece at a suitable and significant point of a tool from the start to the end of the course of force, storing said values of force, determining corresponding values of force for each of the cyclically recurring shaping processes on the workpieces, comparing said corresponding values with the values stored and determining values deviating from the stored values, and taking corrective action so as to eliminate a source of error when the deviating values exceed a predetermined range of tolerance according to the nature of the deviation, and wherein said step of taking corrective action includes checking the association of parts of the tool with respect to each other and/or the blanks based on the deviation values corresponding to a deviation at the start and/or the end of the course of the force from the normal course of the shaping process, and readjusting said association if necessary.

2. The method according to claim 1, wherein said step of taking corrective action includes, determining the nature of the deviation in the event of occurrence of the deviating values of the course of the force from the normal course, associating said nature of the deviation with a specific of the source of error, and displaying identifying error information corresponding to said specific source of error, and wherein said step of taking corrective action includes indicating measures necessary in order to eliminate the source of error for each said error information.

3. The method according to claim 2, wherein said step of taking corrective action includes using each said error information as a control command for direct intervention into operation of a machine performing the shaping.

4. A method of detecting and recognizing deviations from a normal course of cyclically recurring processes for the shaping of workpieces from the solid by cold-working, particularly upon the profiling of elongated blanks of circular cross section by shaping from the solid, for instance upon thread-rolling, the improvement comprising determining values of force employed to carry out a shaping process in case of the normal course of the shaping of a workpiece at a suitable and significant point of a tool from the start to the end of the course of force, storing said values of force, determining corresponding values of force for each of the cyclically recurring shaping processes on the workpieces, comparing said corresponding values with the values stored and determining values deviating from the stored values, and taking corrective action so as to eliminate a source of error when the deviating values exceed a predetermined range of tolerance according to the nature of the deviation, and wherein said step of taking corrective action includes, determining the nature of the deviation in the event of occurrence of the deviating values of the course of the force from the normal course, associating said nature of the deviation with a specific of the source of error, and displaying identifying error information corresponding to said specific source of error, wherein said step of taking corrective action includes indicating measures necessary in order to eliminate the source of error for each said error information.

5. A method of detecting and recognizing deviations from a normal course of cyclically recurring processes for the shaping of workpieces from the solid by cold-working, particularly upon the profiling of elongated blanks of circular cross section by shaping from the solid, for instance upon thread-rolling, the improvement comprising determining values of force employed to carry out a shaping process in case of the normal course of the shaping of a workpiece at a suitable and significant point of a tool from the start to the end of the course of force, storing said values of force, determining corresponding values of force for each of the cyclically recurring shaping processes on the workpieces, comparing said corresponding values with the values stored and determining values deviating from the stored values, and taking corrective action so as to eliminate a source of error when the deviating values exceed a predetermined range of tolerance according to the nature of the deviation, and wherein said step of taking corrective action includes, determining the nature of the deviation in the event of occurrence of the deviating values of the course of the force from the normal course, associating said nature of the deviation with a specific of the source of error, and displaying identifying error information corresponding to said specific source of error, wherein said step of taking corrective action includes using each said error information as a control command for direct intervention into operation of a machine performing the shaping.

* * * * *